United States Patent [19]

Michaels et al.

[11] Patent Number: 4,669,400

[45] Date of Patent: Jun. 2, 1987

[54] APPARATUS AND METHOD FOR AUTOMATICALLY MATCHING THE CUFFS OF GARMENTS

[75] Inventors: Sid Michaels, Garland; Glenn Harvey, Carrollton, both of Tex.

[73] Assignee: Levi Strauss & Co., Richardson, Tex.

[21] Appl. No.: 652,237

[22] Filed: Sep. 19, 1984

[51] Int. Cl.[4] ..... D05B 35/04

[52] U.S. Cl. ..... 112/121.26; 112/121.15; 112/148; 112/153; 112/304; 112/305

[58] Field of Search ..... 198/420; 112/306, 121.15, 112/318, 121.26, 148, 153, 304, 305

[56] References Cited

U.S. PATENT DOCUMENTS

| | | | |
|---|---|---|---|
| 3,713,408 | 1/1973 | Deeks et al. | 112/121.15 |
| 3,905,316 | 9/1975 | Mall | 112/153 |
| 4,013,025 | 3/1977 | Marforio | 112/121.26 |
| 4,036,156 | 7/1977 | Becker et al. | 112/121.26 |
| 4,037,546 | 7/1977 | Kleinschmidt | 112/121.26 |
| 4,062,309 | 12/1977 | Pollmeier et al. | 112/121.15 |
| 4,086,860 | 5/1978 | Kosrow et al. | 112/153 |
| 4,292,908 | 10/1981 | Blessing | 112/306 |
| 4,421,044 | 12/1983 | Freermann et al. | 112/148 X |

FOREIGN PATENT DOCUMENTS

| | | | |
|---|---|---|---|
| 2454030 | 5/1976 | Fed. Rep. of Germany | 112/121.26 |

*Primary Examiner*—Werner H. Schroeder
*Assistant Examiner*—Andrew M. Falik
*Attorney, Agent, or Firm*—Malcolm B. Wittenberg

[57] ABSTRACT

An apparatus and method for accurately aligning the top and bottom edges of a garment's workpieces to assure even cuffs after sewing, the apparatus comprising two locking jaw assemblies which cooperate with drive rollers (all of which are located upstream of the sewing head) and the conventional bottom feed action of the lower feed dogs on a sewing machine to capture any excess length or slack of the garment's panels between the locking jaws (to match the cuffs ) and then to drive any excess slack out of the panels as they are fed to the sewing head to be sewn.

18 Claims, 26 Drawing Figures

A
B
C
2
4
8a
16a
18a
15
13a
13b
13c
17a
17b
24a
26a
12a
14a
8
9

APPARATUS AND METHOD FOR AUTOMATICALLY MATCHING THE CUFFS OF GARMENTS

FIELD OF THE INVENTION

The invention relates to an apparatus and method for automatically aligning the top and bottom ends of a pair of fabric panels and maintaining that alignment during sewing.

BACKGROUND OF THE INVENTION

Nearly every type of garment, other than those which are molded or knitted, requires seams. Equally so, nearly every type of garment which has been seamed together requires that there be some type of hem or cuff in the garment as well as a waistline of some sort. Seaming fabric together to form garments is a rather complicated task, and only highly skilled operators, after prolonged training, are used for such operations. It requires even greater skill from the operator to ensure that the bottom edges (cuffs or hems) and top ends (waistband, etc.) are straight and even with respect to each other during and after sewing of the garment's seams.

While there have been a number of machines which have attempted to match the cuff of garments which are sewn together with side seams, by far the most widely used and near accurate method has been to manually match the bottoms and top ends of the fabric by pulling and stretching one piece of the fabric relative to the other piece and then holding the ends together so that the cuff, waist and seams come out even. Notwithstanding the widespread manual method for accomplishing the task of aligning the top and bottom ends of side seams of fabric, there are a number of apparatuses (some semi-automatic) which have been used in an attempt to accomplish this difficult task.

A number of prior art patented devices have been directed toward applying a continuous tension and stretch to both panels of the garment in an attempt to make them even as they approach the sewing station. For example, U.S. Pat. Nos. 3,717,408; 3,905,316; 4,013,025; 4,036,156; 4,062,309; and 4,086,860 are directed to such devices. Each of these references in some way applies an undetermined amount of tension and stretch to the two panels of fabric by gripping them at one end with a clamp or some other means of securing the fabric while tension is applied and then pulls the fabric in the direction opposite the clamp in an effort to stretch the two panel ends even. None of the apparatuses set forth in any of the aforementioned patents discloses a means for monitoring the actual length of two pieces of fabric and then correcting for that discrepancy in conjunction with sewing head feeding, without applying any unnecessary tension, stretch or other pressure on both panels of fabric. Similarly, the prior art devices are not accurate in their manner of correcting the mismatch of fabric lengths and as such necessarily result in a lot of guesswork as well as unnecessary tension being applied to the fabric. These prior art devices are largely dependent on the skill of the worker and thus result in too much variance and chance for error.

Still another common problem in most prior art methods and apparatuses used to match panel ends results from the pull of the bottom panel by the bottom feed dog in typical sewing machines. That is the bottom feed dog pulls the bottom panel more than the top panel is pulled by the smooth non-driven presser foot which comes into contact with the top panel. The presser foot does not have gripping teeth like the bottom feed dog. Thus, a method is needed to match panel ends which recognizes this known problem which results when the bottom feed dog exerts this pull on the bottom panel.

Despite the available patented devices, it is apparent that the most widely used method of matching a pair of fabric workpieces prior to sewing them along their seams is to manually manipulate the workpieces by independently pulling and stretching them, one relative to another, and subsequently feeding both workpieces into the workstation where they are sewn together as tension is continuously applied to them manually to make sure that the cuff and the waist come out even. This manual method is further frustrated by the unequal pull which is exerted on the bottom panel by the bottom feed dog.

SUMMARY OF THE INVENTION

In view of the above disadvantages of the prior art methods and apparatuses for insuring that the top and bottom ends of the seams of two workpieces sewn together come out even after they are sewn together, it is apparent that there is a need in the garment industry for an apparatus and method to monitor the actual discrepancy in the length of the fabric and then correct only that discrepancy in conjunction with sewing head feeding without applying any unnecessary stretch, stress or other tension on both panels of fabric such as when the panels are manually stretched.

Accordingly, we have invented an apparatus and method which overcomes all of the known disadvantages of the prior art methods and/or apparatuses for accomplishing this goal.

The apparatus of this invention utilizes drive rollers positioned between the sewing head and a pair of locking jaw cuff clamps along the transport path of the workpieces to the sewing head. The drive rollers operate in conjunction with the locking jaw cuff clamps to keep the panels tight between the rollers and the cuff clamps by pushing ahead any excess slack where it is pulled forward and sewn by the sewing head or workstation.

The method and apparatus of this invention is used in conjunction with the known tendency of the bottom feed dog to exert a pull on the bottom panel where a predetermined amount of the bottom panel is positioned between the pair of cuff clamps. This preset mismatch provides an unbalanced tension in the panels to offset the uneven sewhead feeding. The drive roller-cuff clamp combination will only match an amount equalled to or less than the preset mismatch amount. If a greater correction is desired, then this preset amount must be increased.

As will be more particularly pointed out hereafter, the torque/drive rollers pull up the mismatch (trapped between the locking jaw cuff clamps) when the first of these clamps are released. The excess length which is in the bottom panel is distributed along the last portion of the garment to assure an even cuff.

Conveyor clamps of the inventive apparatus and method engage both upper and lower panels and pull each forward independently until the trailing edge of each is detected by independent sensors, such as photocells. The photocell stopping point for the upper panel is at a predetermined distance closer to the workstation than that of the lower panel. When both panels have been driven to these sensor points by the drive rollers, the first set of locking jaws closest to the workstation is closed gripping both pieces of fabric together. The set of drive rollers on the lower panel which is stopped at a predetermined distance longer than the upper panel then are reactivated to bring the trailing edge of the lower panel to a position even with the upper panel. At this point, the second set of locking jaws is engaged gripping the two matched ends of the fabric together and trapping a portion of the lower fabric panel between the two jaws. The result of this trailing and engagement system is that a greater resisting tension is applied to the lower panel than the upper panel for sewing at the workstation.

Once the workpieces get trapped by both of the two locked jaws, the conveyor clamp pulls the fabric towards the workstation as tension is constantly being applied to the fabric via the locked jaws, resulting in the fabric being stretched unevenly. As the conveyor feeds toward the workstation, the two panels are carried through two independent torque/drive roller systems, one for the upper and one for the lower panel, and then into the workstation/sewing machine. The torque/-drive rollers provide a combination of feeding torque and steering control to provide a combined effect of independent edge guidance of the two panels and tension manipulation to provide even sewing. The workstation/sewing machine presser foot/clamping device is clamped on the leading edge of the panels and sewing initiated. The contour sewing aides/torque motor system is activated to provide edge guidance and provides an equal torque through the rollers to both upper and lower panels independently. The result of this torquing action is that all slack will be removed from both upper and lower panels and the fabric between the torque rollers and the sewing machine is dependent totally on the differences in the length of the fabric.

If the two panels are of equal length, then the lower panel will be under greater tension because of the differential amount of fabric held between the two locked jaws. If the lower panel is shorter, there will be even greater tension on the lower panel because of the shortness plus the differential fabric between the jaws. If the upper panel is shorter by an amount less than the differential between the two panels in the gripper jaws, then the tension on the lower panel will still be greater. If the upper panel is shorter by an amount greater than that held between the two gripper jaws, the tension will be greater on the upper panel.

The basic principle is that the workstation/sewing machine will feed the panel with the least tension the fastest, taking up the differences in length. It is necessary to overcompensate for this effect because of the greater feeding effect of the lower feed dogs on the sewing machine and, hence, the over-tensioning of the lower panel artificially. Even with top feed devices used on the sewing machines of the present designs or state-of-the-art, lower feeding is still more effective than upper feeding.

After approximately two-thirds of the panel has been sewn, the clamping jaw closest to the workstation is opened allowing the artificially added fabric on the lower panel to be released. This allows the sewing machine to act in a normal fashion and end up with cuffs matched or ends matched at the end of sewing. When the cuffs are as close as possible to the sewing machine as determined by mechanical design, the second locking jaw farthest from the workstation is opened and the remaining sewing is continued with no gripping of the trailing edge.

It is therefore an object of this invention to provide an apparatus and method for automatically matching the top and bottom ends of two workpieces regardless of the mismatch and the size of the workpiece.

It is a further object of this invention to provide for an apparatus and method for automatically matching the inseams as well as the outside seams of a garment formed with two workpieces.

The foregoing and other objectives, features and advantages of the invention will be readily understood upon consideration of the following detailed description of the best mode for carrying out the invention, when made in conjunction with the accompanying drawings.

BRIEF DESCRIPTION OF THE DRAWINGS

FIGS. 4A through 4C are schematic illustrations of the operation of the apparatus of the invention on two workpieces or panels of the same length;

FIGS. 5A through 5C are schematic illustrations of the operation of the invention on two panels where the top panel is shorter than the bottom panel;

FIGS. 6A through 6C are a schematic illustrating the operation of the invention on two panels where the bottom panel is shorter than the top;

DESCRIPTION OF THE PREFERRED EMBODIMENTS

Figures 1, 2:
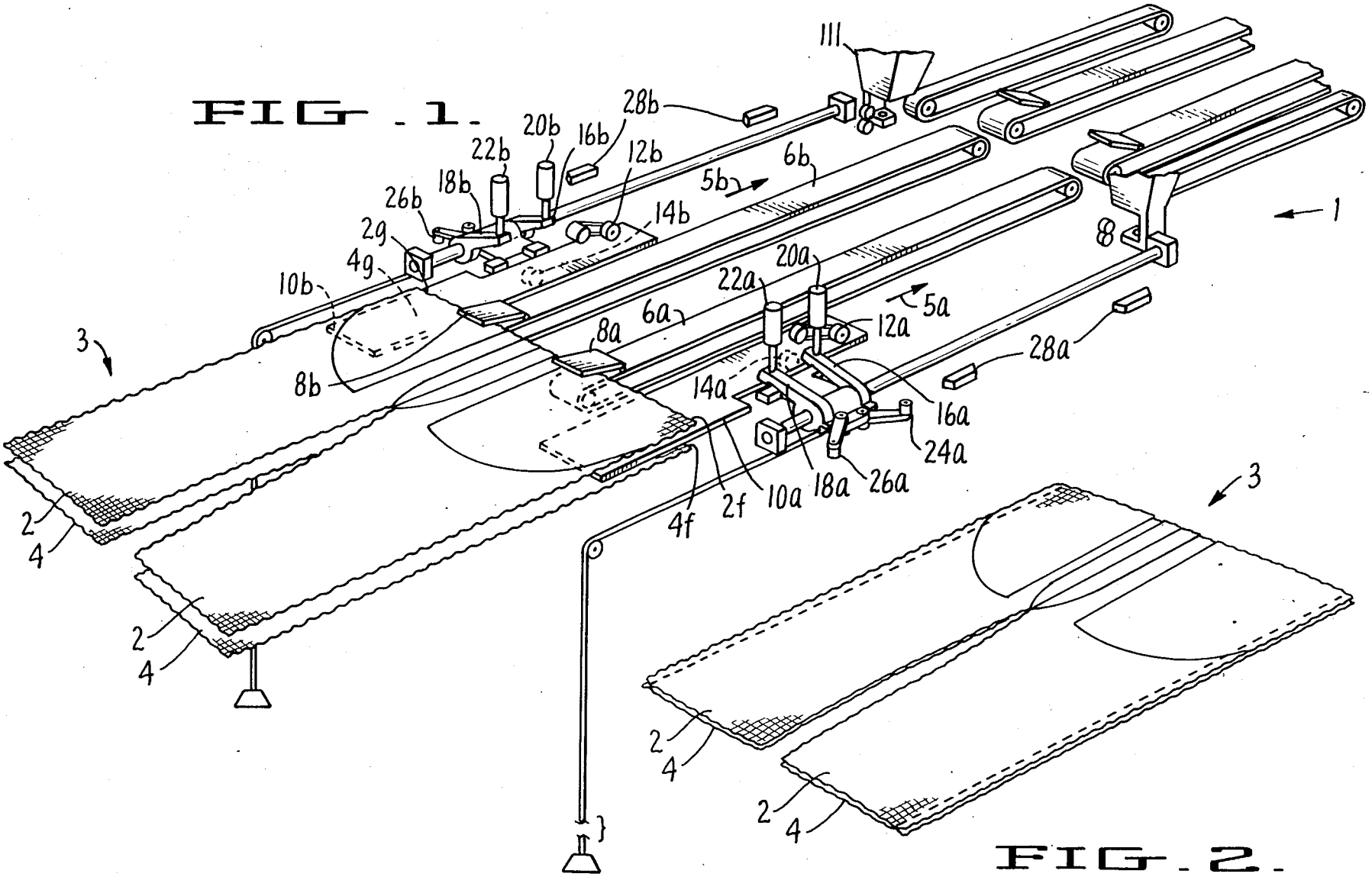
FIG. 1 is a pictorial schematic of the apparatus of the invention.
FIG. 2 illustrates a pair of pants or trousers with the side seams and congruent bottom ends or hems.

Perhaps the apparatus and method of the invention are best understood by considering FIGS. 1 and 3A through 3H together, initially, for an overall explanation of how the apparatus is constructed and how the various parts cooperate with each other to practice the invention and to accomplish the goal of evenly matching the cuffs of panels of fabric. The apparatus is generally illustrated in FIG. 1 by reference numeral 1. A garment 3 (FIG. 2) having workpiece panels 2 and 4 is introduced onto conveyor belts 6*a* and 6*b* where the top edges 2*f*, 4*f*, 2*g* and 4*g* (or the waists) of the panels are gripped by conveyor clamps 8*a* and 8*b*. Workpiece panels 2 and 4 are further separated about stationary separator plates 10*a* and 10*b*. Conveyor belts 6*a* and 6*b* are then energized in a routine manner to transport workpiece panels 2 and 4 in the direction of arrows 5*a* and 5*b* towards a workstation 111 (FIG. 3A through 3H) where garment side edges 2*a* and 4*a* and 2*c* and 4*c* are sewn together, respectively.

As conveyor belts 6*a* and 6*b* transport workpieces 2 and 4 in the direction of workstation 111, sensors 13*b* and 13*a* (three sensors such as 13*a*, 13*b* and 13*c* are positioned along the path of each leg or panel of a garment having two side edges, thus with a pair of pants there will be six sensors) are positioned along the path of panels 2*a* and 4*a* to detect the cuff ends of the panels.

Figure 3:
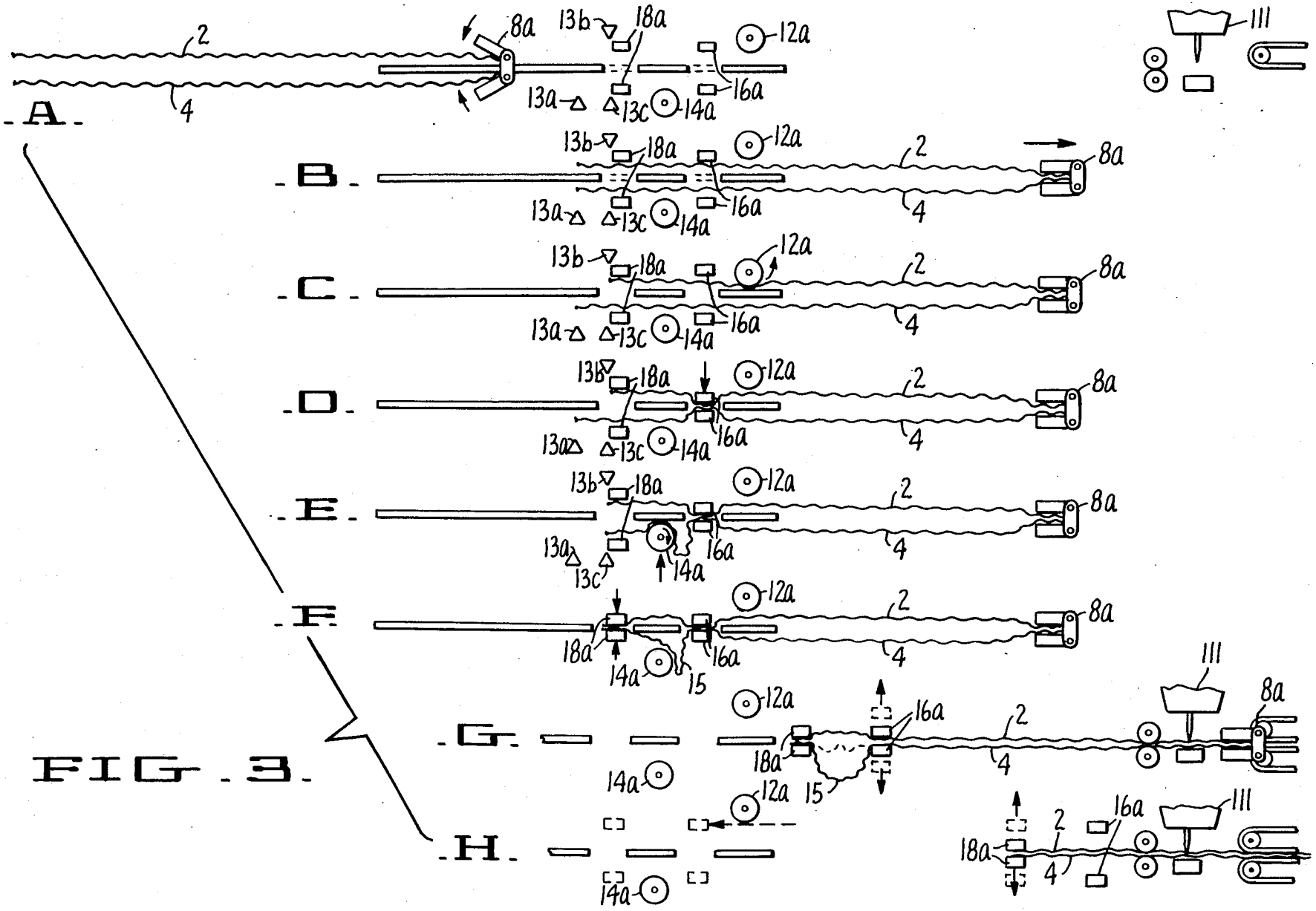
FIG. 3A is a side elevation schematic of the clamping leading edge of a garment's panels.
FIG. 3B illustrates the advancing panels until the shortest panel is detected.
FIG. 3C illustrates the advancing upper and lower panels to a predetermined position with a predetermined mismatch after the shortest panel has been detected.
FIG. 3D illustrates the closing of the first locking jaw.
FIG. 3E illustrates the advancing of the lower panel until the trailing end of both panels are congruent.
FIG. 3F illustrates the closing of the second locking jaw.
FIG. 3G illustrates the path of both panels with both locking jaws closed as the panels are being pulled toward the workstation.
FIG. 3H illustrates continuous sewing of panels while they are being stretched to take up the excess in fabric and when cuffs are as close as possible to the sewing machine the second locking jaw is opened and the clamp assembly returns to start the process over.

Sensors 13*a*, 13*b* and 13*c* are positioned along the path of panels 2 and 4 upstream of locking jaws 16*a*, 16*b*, 18*a*, and 18*b*, and workstation 111. As workpiece panels 2 and 4 move towards workstation 111 and one of sensors 13*a* and 13*b* is first uncovered by either panel 2 or 4, conveyor belts 6*a* and 6*b* are immediately deenergized to halt the movement of panels 2 and 4 and the conveyor at sensor 13*a* or 13*b*. Panel 2 or panel 4 which is not yet at sensor 13*a* or 13*b* respectively is advanced ahead by drive rollers 12*a* and 12*b* or 14*a* and 14*b* towards workstation 111. Now the end of top panel 2 is at sensor 13*b* and the end of bottom panel 4 is at 13*a*as is illustrated in FIG. 3B. Panel 2 is ahead of panel 4 by a predetermined amount, such as ¾". It should be pointed out that the above described procedure takes place even if both panels or cuffs are initially even with each other. In such an instance even cuffs are guaranteed.

When cuff ends of top and bottom panels 2 and 4 are at sensors 13*b* and 13*a* respectively, drive rollers 12*a* and 12*b* and 14*a* and 14*b*, are de-energized. Upon the de-energization of the drive rollers 12*a* and 12*b*, jaws 16*a* and 16*b* are energized with pneumatic cylinders 20*a* and 20*b*, causing each of jaws 16*a* and 16*b* to firmly grip both workpiece panels 2 and 4 between the locked jaw. Once panels 2 and 4 have been gripped by the first of the two locking jaws, drive rollers 14*a* and 14*b* are then energized to engage panel 4, thus advancing panel 4 forward in the direction of workstation 111 until trailing edges 2*c* and 4*c* and edges 2*d* and 4*d* of each panel 2 and 4 are respectively aligned with each other at sensors 13*b* and 13*c* respectively. Once this alignment has been accomplished, jaws 18*a* and 18*b* are energized by pneumatic cylinders 22*a* and 22*b*, causing the jaws to close gripping both workpieces 2 and 4, thus trapping a slack portion of panel 4 between the two sets of locking jaws. Thereafter, conveyor belts 6*a* and 6*b* are again energized to move in the direction of arrow 5*a* and 5*b* as conveyor clamp 8*a* and 8*b* pull panels 2 and 4 ahead towards workstation 111.

As clamps 8*a* and 8*b* pull the two panels toward workstation 111, tension is continuously being applied to panels 2 and 4 by a force restricting the motion of the clamping station as they enter under the sewing head. Tension in the bottom panel 4 is increased because of the slack portion trapped between the two locking jaws.

This compensates for the uneven feed of the sewing machine and creates matched sewing. Once panels 2 and 4 are approximately two thirds (⅔) the distance through the sewing head 111, the first jaw 16*a* or 16*b* of FIG. 1 is opened by a cam and is held open by a compression spring (See FIG. 10). As first jaw 16*a* or 16*b* 160 is opened, clamp 18*a* or 18*b* 18 continues to exert a pull and tension on workpiece panels 2 and 4 and the lower feed dog (a well known and common feature on most sewing machines and not illustrated here) continues to exert a pull and tension on the bottom panel until the cuffs of panels 2 and 4 are as close as possible to the sewing machine as is determined by mechanical design, then the second jaw is opened as the remaining portion of the garment is sewn.

Once both locked jaws 16*a* and 18*a* have been returned to their opened position, these jaw assemblies are again returned to a position upstream of workstation 111 (see location of locking jaws 16*a*, 16*b*, 18*a* and 18*b* of FIG. 1). There, the rollers and jaws are readied to again engage other workpiece panels which are being transported along conveyor belts 6*a* and 6*b* in the direction of arrows 5*a* and 5*b* toward workstation 111. That is, the locking jaws are returned to their original upstream position via a cable which is attached to the jaw assemblies and which is tensioned by a weight or spring such that when the jaws are released and no longer being pulled by the garment to the workstation, the cable pulls the assembly back to its original home position.

FIGS. 4A through 4C illustrate how the apparatus and method of the invention will operate on panels 2 and 4 to assure that these panels are always equal in length when they are introduced to workstation 111. The apparatus of the invention provides for this guarantee, despite the fact that panels 2 and 4 may be initially equal in length. The same type of forward movement of the panel 2 and panel 4 is accomplished by drive rollers 12*a* and 14*a* with an amount of fabric panel 4 being trapped between jaws 16*a* and 18*a* (reference numeral 15), despite the fact that neither panel 2 nor panel 4 is any shorter than the other panel. This result is accomplished because sensors 13*a* and 13*b* are constantly operating to de-energize conveyor belts 6*a* and 6*b* once one of the panels has passed the sensor point. Specifically, sensors 13*a*, 13*b*, and 13*c* are photosensors consisting of a light source 123 and a receiver 125 which remains dark while a panel passes between the light source and the receiver (See FIG. 11). However, when the edge of the panel reaches the sensor, the receiver detects the light and signals the conveyor belt drive motor to stop. But note that where the panels are equal in length, sensor 13*a* will first be uncovered and the conveyor will stop, thus causing the drive rollers to advance the panel proximate sensor 13b by a predetermined distance downstream towards the workstation. Locking jaw 16a is then energized to grip both panels and a second set of drive rollers will advance the panel proximate sensor 13b until both trailing edges are equal or even with each other, at which time the second locking jaw 18a will grip both panels of fabric.

A similar situation is true in FIGS. 5A through 5C where panel 4 is initially longer than panel 2. The same type of correction is made for the discrepancy in the length between panels 2 and 4. Similarly, FIGS. 6A through 6B illustrate how the apparatus and method of this invention will operate to correct a discrepancy in length between panels 2 and 4 where panel 4 is shorter than panel 2.

In the instance of FIGS. 5A–5C, where panel 2 is shorter than panel 4, the first one of sensors 13a or sensor 13b to be uncovered will depend upon the difference in lengths of panels 2 and 4. In the example used here, if panel 2 is ¾ inch or less shorter than panel 4, then sensor 13a will be first uncovered by panel 4 first as it travels along the conveyor belt. If panel 2 is more than ¾ inch shorter than panel 4, then sensor 13b will be first uncovered as panel 2 travels along the conveyor belt 6a past sensor 13b.

On the other hand, FIGS. 6A–6C illustrate what happens when panel 4 is shorter than panel 2. If the difference in panel lengths is ¾" or less, sensor 13a is first uncovered. However, if the panels differ in length by more than ¾" with panel 2 being the longer of the two, sensor 13a will still be uncovered first since panel 4 will always pass sensor 13a first if panel 2 is longer than panel 4 by any amount because of the location and position of the sensors.

Figures 4, 5, 6, 7:
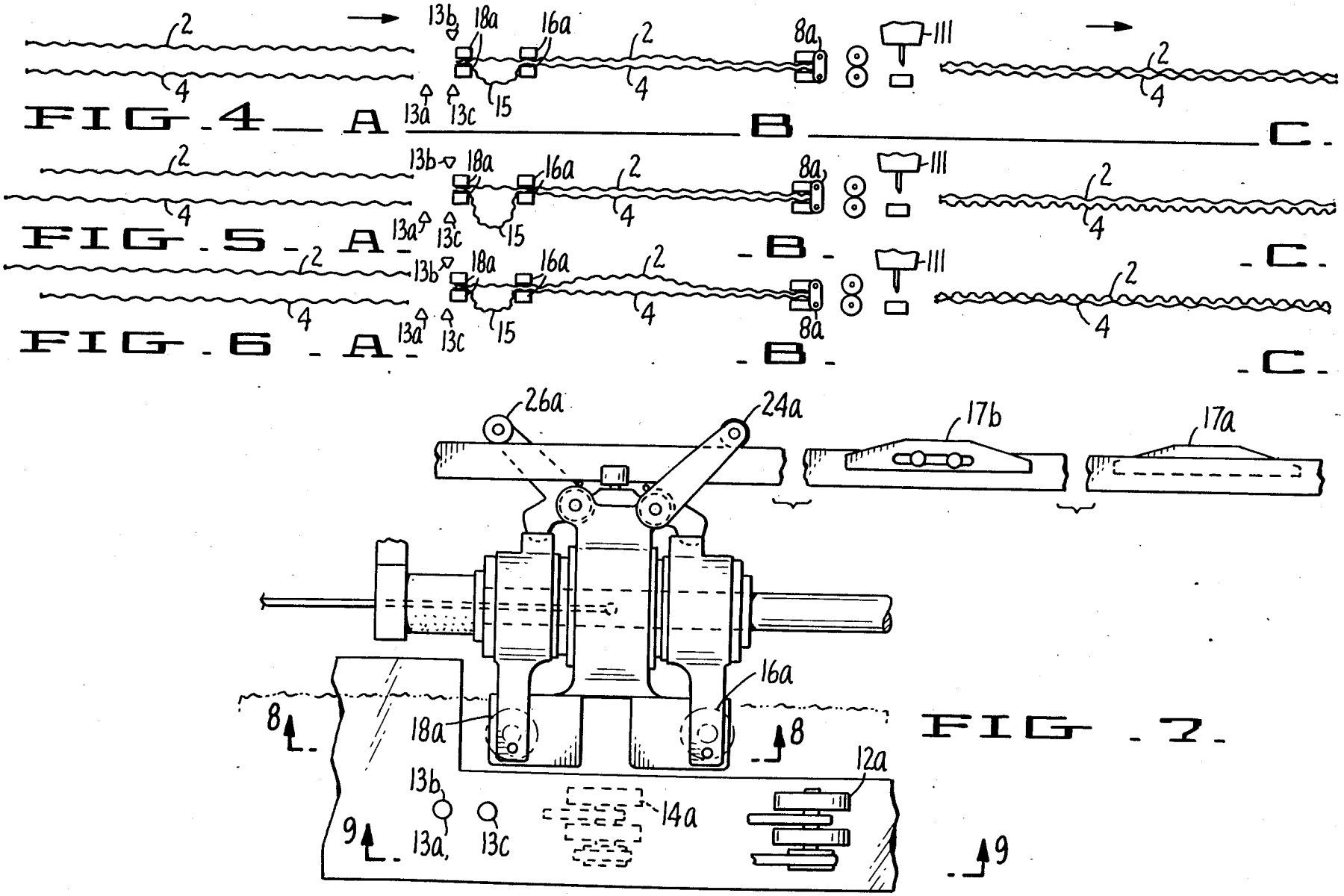
FIG. 7 is a fragmentary plan view of the sensing and clamping station of the apparatus and a rail with clamp opening trips, together with the drive roller used to advance the panels to a pre-determined sensor.

FIG. 7 further illustrates by way of a top plan view how sensors 13a, 13b, and 13c are positioned to monitor the fabric workpieces 2 and 4 to determine the shorter of the two pieces (or when a sensor is first uncovered by either workpiece, regardless of the relative lengths of the workpieces) as they move along the conveyor means to become engaged by drive rollers 12a and 14a. Locking jaws 16a and 18a are shown here in their locked positions as they travel along the path of conveyor belts 6a and 6b where jaws 16a and 18a are released from their locked position by cams 17a and 17b, respectively. Cams 17a and 17b are designed to operate on jaws 18a and 16a respectively, when they are nearing the sewing workstation.

Cam followers 24a and 26a ride cams 17a and 17b respectively as locking jaws 18a and 16a approach the sewing workstation 111. Just before the workpiece is passed to and through workstation 111, locking jaw 16a is opened by cam follower 24a and the workpiece proceeds through sewing head 111. Jaw 16a is spring loaded opened by cam follower 24a. Similarly, cam follower 26a spring loads locking jaw 18a opened as the portion of the wordpiece which is gripped by jaw 18a nears sewing head 111. Once the garment is released by both locking jaws 16a and 18a, the garment passes completely through sewing head 111 and locking jaws 16a and 18a are returned via an attached cable to their original upstream positions.

Figure 8:
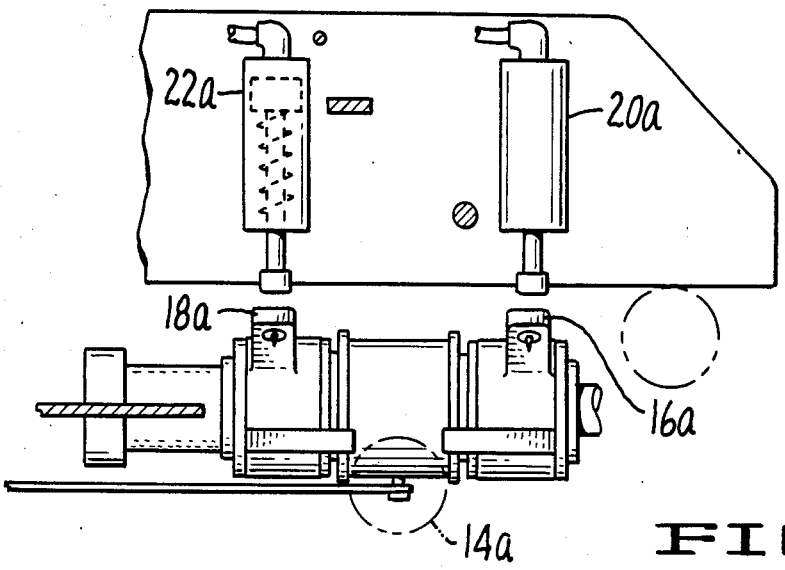
FIG. 8 is a sectional view of the cylinders used to close the locking jaws for clamping the fabric.

FIG. 8 illustrates pneumatic cylinders 20a and 22a which operate upon each of jaws 16a and 18a, respectively, to lock the jaws about the surface portions of fabric pieces 2 and 4, respectively.

Figure 9:
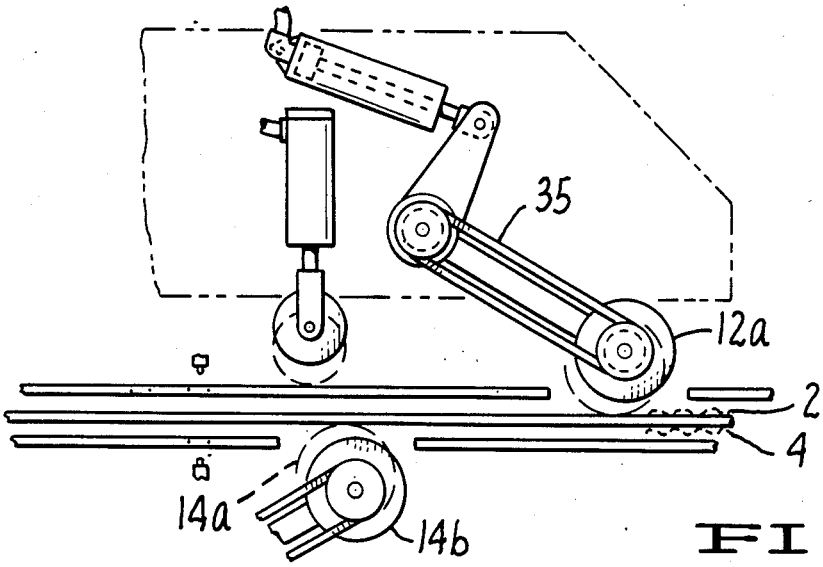
FIG. 9 is a sectional view showing the advancing rollers, their drives and how the rollers pinch the panels if fabric against separator plates.

FIG. 9 is intended to illustrate the relative motions of drive rollers 12a and 12b and rollers 14a and 14b as the rollers engage fabric workpieces 2 and 4 being transported along conveyor belts 6a and 6b in the direction of workstation 111.

Figure 10:
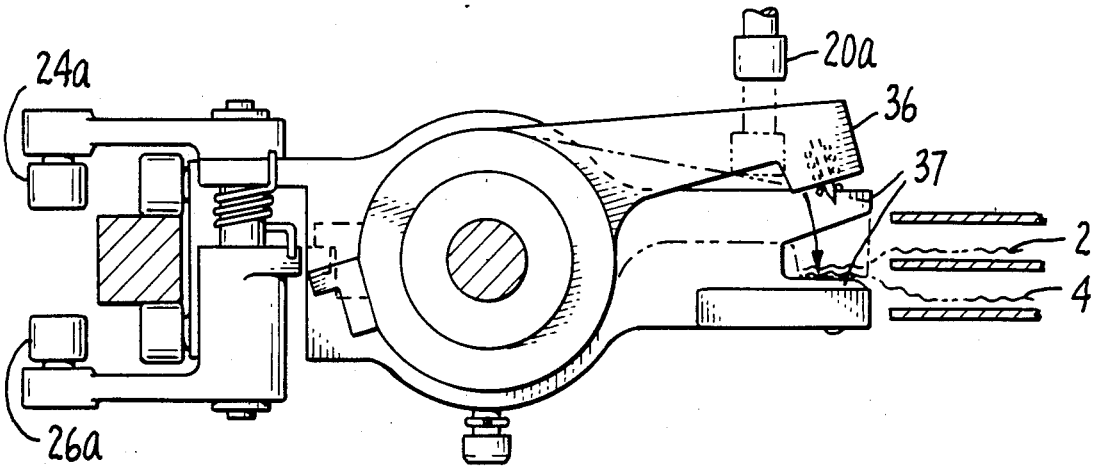
FIG. 10 is an end sectional view of one of the locking jaws in the open position and a compression spring keeping the jaw open.

FIG. 10 illustrates a locking jaw suitably designed for use in the practice of the invention where the locking jaw has a pin 36 for immediately gripping and stabilizing fabric workpieces 2 and 4 as jaw 37 prepares to grip and trap a portion of workpieces 2 and 4 within the jaw.

Figure 11:
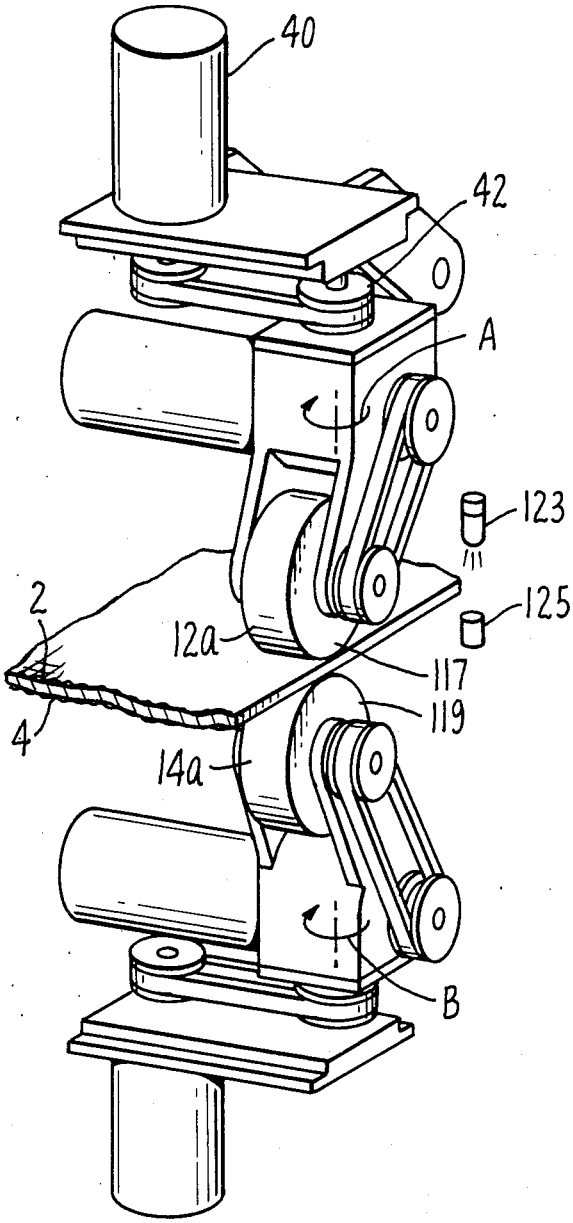
FIG. 11 is a perspective view of the torque roller steering system, with an arrow indicating the direction of rotation of the roller assemblies.

FIG. 11 illustrates a torque roller steering system, having torque motor 40 and pulley timing belt assembly 42 which is suitably designed for use in the practice of the invention. Upper and lower torque/steering rollers 12a and 14a engage fabric pieces 2 and 4 respectively and transfer any slack in the fabric panels to the area between the torque rollers and the sewing head. Torque motor 40 and the pulley-timing belt assembly 42 operate to rotate drive rollers 12a and 14a about their vertical axis in the direction of arrows A and B, respectively, to move the workpieces along the conveyor belt towards workstation 111.

Figure 12:
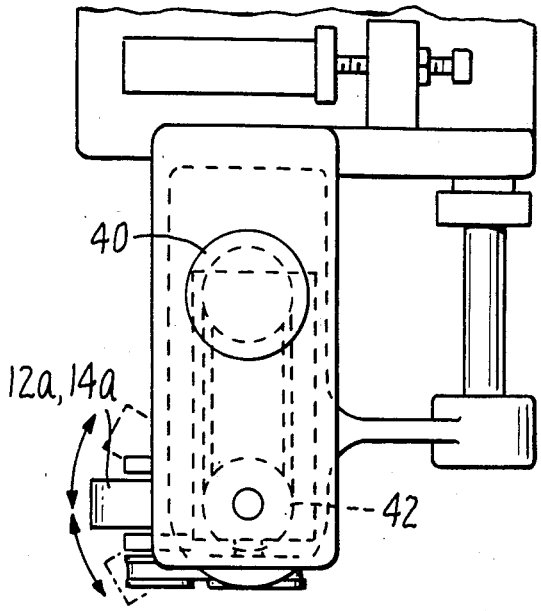
FIG. 12 is a top plan view of the same torque roller system of FIG. 11.
Figure 13:
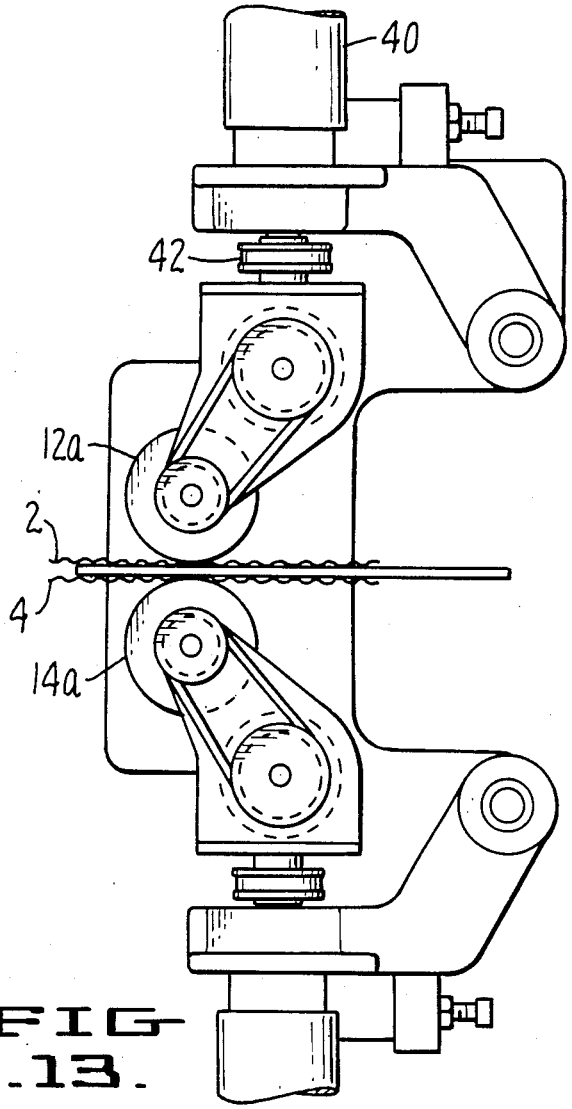
FIG. 13 is a side elevational view of the same torque roller steering system of FIG. 11.

FIGS. 12 and 13 similarly illustrate the torque roller assemblies having rollers 12a and 14a from two different perspectives, with rollers 117 and 119 not being visible in the FIG. 12 view. The system also provides a guide means 28a and 28b (see FIG. 1) for aligning the edges of the fabric panels to a fixed reference so that they are matched together horizontally when sewn together in the sewing head.

It should be pointed out that in each instance of the inventive apparatus, guide means 28a and guide means 28b (FIG. 1) are situated along the side edges of conveyor belts 6a and 6b. These guide means in each instance cooperate with the torque roller assemblies to align side seam 2a with 4a and side seam 2b with 4b. Guide means 28a and 28b may be any suitable alignment means and any variation of edge guide means is intended to fall within the scope of this invention.

The apparatus of the invention has been described utilizing two units made in accordance with the teachings of this invention so that a garment such as a pair of pants having two seams can be fed to a sewing workstation and have the two seams sewn together simultaneously and also have any discrepancies in the relative length of the two panels forming the garment compensated for just prior to the garment being introduced to the workstation. It is to be understood, however, that the apparatus of the invention is of equal utility where a garment has but one seam and where adjustments or compensation must be made to correct discrepancies in (or to guarantee) the length of two panels forming the garment. Thus, the apparatus of the invention is equally useful in a single seam environment. Similarly, the device of the invention may be used for matching the trailing ends or cuffs of garments or fabric pieces where any other seam (such as inseams) of the garment is being introduced to the workstation.

Likewise, the invention has been described where the discrepancy between panels 2 and 4 have been but three-quarter inch (¾ inch), but it should be readily understood and recognized that any discrepancy in the lengths of two panels can be compensated for with the apparatus of this invention and can be done within the spirit and scope of this invention.

It should be pointed out that in each instance of the inventive apparatus, means are situated along the path of conveyor belt 6a and 6b for aligning side seams 2a with 4a and side seams 2b with 4b. These means, illustrated as 28a and 28b in FIG. 1, may be any suitable alignment means and any variations in these means is certainly intended to fall within the scope of this invention.

This invention is only limited by the following claims. We claim:

1. An apparatus for automatically matching the trailing edges of two overlaid workpiece panels as they are simultaneously transported to a sewing workstation where side edges of the panels are sewn together, comprising:

conveyor means (6*a*, 6*b*) for transporting said panels (2,4) to the workstation (111);

a plurality of sensor means, (13*a*, 13*b*, 13*c*) disposed upsteam of said workstation and along the transporting path (5*a*, 5*b*) of said panels, for sensing the trailing edge of said panels such that when one of said sensor means detects the trailing edge of a panel, said conveyor is de-energized and movement of said panels towards the workstation ceases;

a first fabric engaging means, (12*a*, 12*b*) energized when movement of said panels cease, to engage said panel whose trailing edge has not been detected by one of said sensore means, to advance said panel for a predetermined distance towards said workstation;

a first fabric gripping and locking means, (16*a*, 16*b*) energized when said first fabric engaging means is de-energized, for gripping both of said panels upstream of said worstation;

a second fabric engaging means (14*a*, 14*b*) energized to engage said panel which was first detected by one of said sensors and advance said panel in the direction of said workstation until the trailing edges of both of said panels are even one with the other;

a second gripping and locking means (18*a*, 18*b*) for gripping both of said panels such that an amount of both panels (15) is now trapped between said first and second gripping and locking means; and means for re-energizing said conveyor means to continue movement of said panels towards said workstation with said workpiece panels being continuously tensioned by said gripping and locking means and said conveyor means until the first of said locking means releases said panels proximate said workstation followed by the second one of said locking means releasing said panels just before the trailing edges of said workpiece panels are introduced to the workstation.

2. The apparatus of claim 1 wherein said first and second fabric engaging means are torque rollers and said first and second gripping and locking means are cam-controlled locking jaw assemblies which are spring-biased in their opened positions.

3. The apparatus of claim 2 wherein said torque rollers operate to pull all of the slack out of said workpieces as said workpieces are transported to and through the workstation.

4. The apparatus of claim 1 or 2 further comprising guide means situated adjacent said transport path for aligning the side edges of each of said workpieces with each other.

5. The apparatus of claim 1 wherein said sensor means are photocells.

6. An apparatus for automatically matching the trailing edges of two overlaid workpieces as they are simultaneously being transported along conveyor means to a workstation comprising:

torque drive rollers located upstream of said workstation along the path of each workpiece;

first and second locking jaws, similarly located along the path of said workpieces upstream of said workstation and downstream of said drive rollers and being operatively connected to said drive rollers;

sensor means disposed upstream of said drive rollers for monitoring the lengths of said workpieces and further being operatively connected to said drive rollers and said locking jaws such that when said sensor means are uncovered by one of said workpieces, one of said drive rollers is energized to engage said workpiece not uncovering said sensor to advance said workpiece forward in the direction of said workstation until a second one of said sensors is uncovered by the other one of said workpieces, with the first one of said locking jaws closing and gripping both workpieces securely in the jaw, thereafter one of said rollers is energized to engage and advance said workpiece extending a greater distance behind the first of said locking jaws in a forward direction until the trailing edges of both workpieces are even with each other as determined by two said sensing devices being in coincidence with each other as the second one of said locking jaws closes to grip both workpieces with the jaw, thereafter said workpieces are continuously tensioned as they are transported through said rollers to and through said workstation.

7. The apparatus of claim 6 wherein said sensor is operatively connected to said conveyor means such that when a shorter workpiece is detected said conveyor means is halted thereby interrupting the transportation of said workpieces as said drive rollers advance said workpieces forward to a predetermined position and as said first and then said second locking jaws each grips said workpieces to trap a predetermined amount of said workpieces between said jaws.

8. The apparatus of claim 6 wherein said conveyor means has clamping means for securely gripping said workpieces continuously as they are transported toward said workstation, and said workpieces are gripped by said locking jaws, for continuously tensioning said workpieces as they are transported through said workstation.

9. The apparatus of claims 7 or 8 wherein said locking jaws further comprise a pin for penetrating the workpieces when the jaw is energized and a stripper for thereafter separating the workpieces when the jaw is again opened and the workpieces are fed to and through the workstation.

10. The apparatus of claim 6 wherein said first locking jaw is opened when said workpieces are being transported through said workstation and before said second jaw is opened.

11. The apparatus of claim 6 wherein said locking jaws are each held opened by a spring.

12. The apparatus of claim 6 wherein said locking jaws are each closed by means of a pneumatically-controlled cylinder.

13. The apparatus of claim 6 wherein the first one of said torque drive rollers advances the first one of said workpieces ahead to a predetermined position with a difference in the length of said workpieces behind said drive rollers.

14. A method for automatically matching the trailing edges of two overlaid workpieces as they are simultaneously being transported to a workstation comprising the following steps:

monitoring the lengths of said workpieces as they are being transported to the workstation to detect the shorter of the two workpieces;

advancing one of said workpieces ahead to a predetermined position in the direction of said workstation;

gripping and trapping both of said workpieces between a first locking jaw assembly with a predetermined length difference behind the gripping device;

advancing the other of said workpieces ahead by a predetermined amount in the same direction as the first workpiece is advanced until the trailing edges of both said workpieces are even with each other;

gripping and trapping both of said workpieces between a second locking jaw assembly upstream of said first jaw assembly; and tensioning said workpieces as they continue to be transported to said workstation.

15. The method of claim 14, further comprising the step of clamping said workpieces securely to transport them towards said first locking jaw assembly and for continuously tensioning said workpieces as they are transported to said workstation.

16. The method of claim 14 wherein said step of tensioning the workpieces includes tensioning said workpieces as they are fed through said workstation and said first jaw is opened and said second jaw is opened just before the trailing edges of said workpieces enter said workstation.

17. The method of claim 15 wherein the steps of advancing said workpieces include engaging each of said workpieces with drive rollers to advance the workpiece ahead toward the workstation.

18. The method of claim 15 wherein the steps of gripping and trapping said workpieces includes locking a predetermined portion of said workpieces between the first and second locking jaw assemblies.

* * * * *